United States Patent [19]

Takahashi et al.

[11] Patent Number: 4,581,501

[45] Date of Patent: Apr. 8, 1986

[54] IGNITION DISTRIBUTOR FOR INTERNAL COMBUSTION ENGINE

[75] Inventors: Ken Takahashi, Ibaraki; Ryutarou Jimbou, Hitachiota; Yasuo Matsushita, Hitachi; Seiichi Yamada, Ibaraki; Hiromitsu Nagae, Katsuta, all of Japan

[73] Assignee: Hitachi, Ltd., Tokyo, Japan

[21] Appl. No.: 634,049

[22] Filed: Jul. 25, 1984

[30] Foreign Application Priority Data

Jul. 27, 1983 [JP] Japan ..... 58-138106

[51] Int. Cl.[4] ..... H01H 19/00

[52] U.S. Cl. ..... 200/19 DR; 200/265

[58] Field of Search ..... 200/19 R, 19 DR, 264–267, 200/262; 123/146.5 A, 633

[56] References Cited

U.S. PATENT DOCUMENTS 4,217,470 8/1980 Kirner ..... 200/19 R 4,369,343 1/1983 Sone et al. ..... 200/19 R

*Primary Examiner*—J. R. Scott

*Attorney, Agent, or Firm*—Antonelli, Terry & Wands

[57] ABSTRACT

An ignition distributor for an internal combustion engine with reduced electric discharge energy and suppressed radio noise generation comprises a rotor electrode capable of rotary motion and a plurality of stationary electrodes arranged substantially in a circle around the rotor electrode through an electric discharge clearance therebetween, where the rotor electrode is made of a sintered mixture comprising zirconium oxide and an electroconductive inorganic compound having a specific resistance of not more than $10^6$ Ωcm as main components. The sintered mixture can be $ZrO_2$ and an oxide selected from ZnO, NiO and CoO; or $ZrO_2$, aluminum oxide and an oxide selected from ZnO, CoO, $Al_2TiO_5$ and $SrTiO_3$ or a carbide selected from ZrC, TiC and TaC.

8 Claims, 2 Drawing Figures

IGNITION DISTRIBUTOR FOR INTERNAL COMBUSTION ENGINE

BACKGROUND OF THE INVENTION

1. Field of the Invention

This invention relates to an ingnition distributor for internal combustion engine, and more particularly to an ignition distributor for internal combustion engine with reduced generation of radio noises.

2. Description of the Prior Art

Generally, internal combustion engines having an electric ignition system generate radio noise in a wide frequency range, which disturb radio broadcasting service, television broadcasting service and other kinds of radio communication systems. Particularly, the radio noise from the internal combustion engines of vehicles gives a disturbance to electronic appliances now provided on the vehicles for versatile applications and gives an adverse effect on the vehicle running. One of the noise generation sources is an electric discharge at the ignition distributor for the internal combustion engine.

Attempts have been so far made to suppress the noise generation at the ignition distributor, one of which is to provide a resistor of a few kΩ at the intermediate part of a rotor electrode in the ignition distributor to suppress generation of radio noise with high frequency. However, a discharge voltage is high between the rotor electrode and the stationary electode and an energy loss during the electric discharge is high in such an attempt, resulting in a less effect on suppression of radio noise generation.

Another attempt is to provide a resistor or a dielectric as projected at the tip end of the metallic rotor electrode, where a precursor electric discharge takes place between the resistor or the dielectric and the stationary electrode, and the main electric discharge then takes place therebetween. That is, the electric discharge energy can be reduced, but no effect on oscillation suppression of the main electric discharge current can be obtained, and a less effect on reduction in the radio noise generation can be attained.

SUMMARY OF THE INVENTION

An object of the present invention is to provide an ignition distributor for an internal combustion engine with less electric discharge energy and reduced radio noise generation.

According to the present invention, an ignition distributor for an internal combustion engine is characterized by using a sintered mixture comprising zirconium oxide and an electroconductive inorganic compound having a specific resistance of not more than $10^6$ Ωcm as a rotor electrode, and more preferably characterized in that the sintered mixture has a specific resistance of 10 to $10^6$ Ωcm at room temperature. The sintered mixture may contain a small amount of a sintering aid to improve the sintering ability. As the electroconductive inorganic compound, at least one of nitrides, borides, carbides and silicides of transition elements of groups IIIb, IVb, Vb and VIb of the periodic table, more specifically, Y, Ti, Zr, Hf, V, Nb, Ta, Cr, Mo, W, etc., or metal oxide semi-conductors, more specifically. $TiO_2$, $Nb_2O_3$, $V_2O_5$, $MoO_2$, CdO, ZnO, $SnO_2$, $Fe_3O_4$, $Ta_2O_5$, CoO, $Cu_2O$, $Cr_2O_3$, SnO, MnO, NiO, $WO_3$, etc. or double oxides having an improved electroconductivity, for example, $BaTiO_3$, $SrTiO_3$, etc. can be used.

Such sintered mixture contains high resistance regions comprising zirconium oxide and conductive regions in mixture. Effects of using such a sintered mixture as a rotor electode will be explained as follows. The accumulated electric charges on the high resistance regions at the surface increase the local electric field and lowers the discharge voltage, resulting in reduced electric discharge energy. Furthermore, the high frequency current is controlled by the relatively high resistance effect of rotor electrode to suppress the radio noise generation.

To attain such effects, it is desirable that the specific resistance of sintered mixture is 10 to $10^6$ Ωcm. With too low a specific resistance, no better resistance effect can be obtained, whereas with too high a specific resistance the rotor electrode turns electrically insulating, and can no more play a role of electrode.

When zinc oxide (ZnO), cobalt oxide (CoO), and nickel oxide (NiO) is used in the rotor electrode, it is preferable that the sintered mixture contains 40–95% by volume of these oxides in total and 60–5% by volume of zirconium oxide ($ZrO_2$). It is particularly preferable that a ratio of ZnO to $ZrO_2$ by volume is 7:3 and the sintered mixture further contains a specific resistance-controlling agent. The specific resistance-controlling agent can be exemplified by antimony oxide ($Sb_2O_3$), aluminum oxide ($Al_2O_3$), titanium oxide ($TiO_2$) and magnesium oxide (MgO).

Silicon oxide ($SiO_2$), or $ZnAl_2O_4$, Co $Al_2O_4$, $NiAl_2O_4$, $Zn_2SiO_4$, $Co_2SiO_4$, $Ni_2SiO_4$, etc. can be used as an insulating oxide together with $ZrO_2$.

The sintered mixture for use in the present invention can be prepared by mixing raw material powders, molding the mixture, and sintering the molded mixture by means of hot press or pressureless sintering. When the sintered mixture is used as a rotor electrode, it can be easily mass-produced at low cost, because there is no necessity for combining with other parts of different material.

The sintered mixture for use in the present invention contains $ZrO_2$ as a component, and thus has a high mechanical strength. Furthermore, it contains the inorganic compound as described above as the elctroconductive component, and thus has a good chemical stability and a long durability.

Furthermore, $ZrO_2$ is less reactive to other oxides during the sintering than $Al_2O_3$, and thus the desired sintered mixture can be obtained stably.

DETAILED DESCRIPTION OF THE PREFERRED EMBODIMENTS

Figure 1:
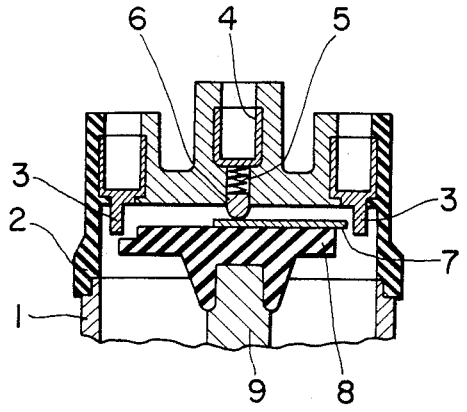
FIG. 1 is a vertical cross-sectional view of one embodiment of an ignition distributor for an internal combustion engine according to the present invention.

FIG. 1 shows a vertical cross-sectional view of an ignition distributor for an internal combustion engine according to one embodiment of the present invention.

Inside a cap 2 on a cylindrical housing 1 are embedded a plurality of stationary electrodes 3 arranged substantially in a circle. The stationary electrodes 3 are connected to ignition plugs provided in a plurality of cylinders in an internal combustion engine. A slidable contact rod 6 is provided at the center on the inside surface of cap 2 through a central terminal 4 and a conductive spring 5. A plate-formed rotor electrode in contact with the contact rod 6 under a pressing force by the spring 5 is fixed to the surface of an insulating substrate 8, and the tip end of rotor electrode 7 faces the sides at the tip ends of stationary electrodes 3 through a small clearance. The insulating substrate 8 and the rotor electrode 7 rotate together with a cam shaft 9, and when the rotor electrode 7 comes to a position facing the stationary electrode 3, an electric discharge takes place between the rotor electrode 7, to which a high voltage is applied from the central terminal 4, and the stationary electrode 3 to allow an electric passage therebetween. At this moment, a high voltage is applied to an ignition plug connected to said stationary electrode 3.

It has been a problem that radio noise with high frequency is generated by the electric discharge between the stationary electode 3 and the rotor electrode 7.

EXAMPLE 1

Powder of zirconium oxide ($ZrO_2$) and powder of aluminum oxide ($Al_2O_3$) were mixed together in various mixing ratios, and further MgO and $Y_2O_3$ as sintering aids and other transition element compounds were added thereto. The resulting powdery mixture was molded under a pressure of 1,000 kg/cm$^2$, and sintered in an argon gas under one atmosphere at a temperature of 1,580° C. for one hour. Rotor electrodes were prepared from the resulting sintered mixtures and mounted on ignition distributors for internal combustion engines.

The electric noise current generated in the ignition distributors provided with the thus prepared rotor electrodes was measured in the following manner. The individual terminals of aluminum stationary electrodes were earthed through a resistor, and an electric discharge current was passed to the earth through the resistor. Both ends of the resistor were connected to the input terminals of a noise-meter and the noise components generated by the electric discharge were measured by the noise-meter.

Figure 2:
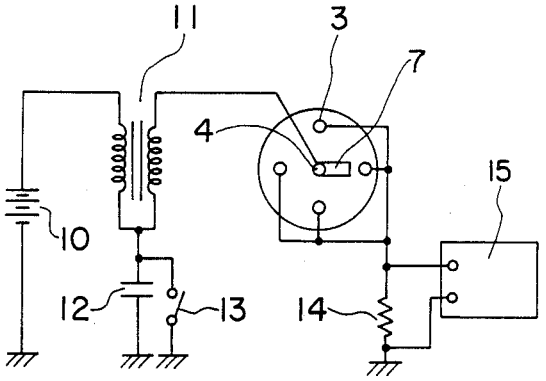
FIG. 2 is a circuit diagram for measuring a noise current generated in an ignition distributor for an internal combustion engine.

The measuring circuit is shown in FIG. 2. A battery 10 is connected to the primary side of an induction coil 11, and other terminal of induction coil 11 is earthed through a condenser 12. The condenser 12 is connected with a primary contact 13 in parallel. The secondary side of induction coil 11 is connected to the central terminal 4, which is further connected to the rotor electrode 7 through the contact rod. The stationary electrodes 3 are arranged in a circle around the rotor electrode 7 through a small clearance, and the individual terminals of stationary electrodes 3 are earthed through a resistor 14. Both ends of resistor 14 are connected to the input terminals of the noise-meter 15. When the primary contact 13 is turned on or off, a high voltage is generated at the secondary side of induction coil 11, and the high voltage is applied to rotor electrode 7. The rotor electrode 7 turns and electric discharging takes place in clearances between the rotor electrode 7 and the individual stationary electrodes 3. The electric discharge current passes to the earth through the resistor 14. Noise components generated by the electric discharging are input into the noise-meter 15. The stationary electrodes 3 are made of aluminum.

Compositions and specific resistance of sintered mixtures used and results of measurement of electric noise current, based on the conventional brass rotor electrode as a reference, are shown in Table 1.

TABLE 1

| Sample No. | Sintered mixture composition wt. % (vol. %) 0.5 wt. % of MgO added on the basis of $Al_2O_3$, and 7 wt. % of $Y_2O_3$ added on the basis of $ZrO_2$ | Specific resistance at 20° C. (Ωcm) | Electric noise current (dB) |
|---|---|---|---|
| 1 | $Al_2O_3$ 80(86), $ZrO_2$ 5(4), ZrC 15(10) | $2 \times 10$ | −13 |
| 2 | $Al_2O_3$ 45(65), $ZrO_2$ 15(15), $HfB_2$ 40(20) | $5 \times 10^0$ | −5 |
| 3 | $Al_2O_3$ 50(57), $ZrO_2$ 35(29), TiC 15(14) | $2 \times 10^4$ | −27 |
| 4 | $Al_2O_3$ 34(43), $ZrO_2$ 34(31), $ZrB_2$ 32(26) | $4 \times 10^{-3}$ | −3 |
| 5 | $Al_2O_3$ 20(35), $ZrO_2$ 35(44), TaC 45(21) | $7 \times 10^3$ | −19 |
| 6 | $Al_2O_3$ 15(21), $ZrO_2$ 50(51), $NbB_2$ 35(28) | $6 \times 10^9$ | — |
| 7 | $ZrO_2$ 80(77), $TiB_2$ 20(23) | $8 \times 10^5$ | −20 |
| Brass rotor electrode | | | 0 |

As is evident from the results, a high noise-suppressing effect can be obtained, when the specific resistance of the sintered mixtures is 10 to $10^6$ Ωcm.

When copper and stainless steel stationary electrodes were used, the similar results could be obtained. When sintered mixtures prepared by hot pressing were used as rotor electrodes, the similar results could be obtained.

When the sintered mixtures were mounted as rotor electrodes in ignition distributors in the present example, no breakage was observed at all. It seems that the sintered mixtures had a strength high enough to withstand the load applied during the fabrication.

EXAMPLE 2

Sintered mixtures of $Al_2O_3$, $ZrO_2$ and various semiconductor oxides were prepared in the similar manner as in Example 1 and ignition distributors for internal combustion engines were assembled, using the sintered mixtures as rotor electrodes. Then, the electric noise current was measured in the similar manner as in Example 1. Compositions and specific resistance of sintered mixtures and results of measurement of electric noise current, based on the conventional brass rotor electrode as a reference, are shown in Table 2.

As is evident from the results, a high noise-suppressing effect can be obtained when the specific resistance of sintered mixtures is 10 to $10^6$ Ωcm.

TABLE 2

| Sample No. | Sintered mixture composition wt. % (vol. %) 1 wt. % of MgO added on the basis of $Al_2O_3$ and 8 wt. % of $Y_2O_3$ added on the basis of $ZrO_2$ | Specific resistance at 20° C. (Ωcm) | Electric noise current (dB) |
|---|---|---|---|
| 8 | $Al_2O_3$ 55(57), $ZrO_2$ 5(4), $TiO_2$ 40(39) | $4 \times 10^0$ | −2 |
| 9 | $Al_2O_3$ 50(60), $ZrO_2$ 30(26), $SnO_2$ 20(14) | $2 \times 10^7$ | −3 |
| 10 | $Al_2O_3$ 20(24), $ZrO_2$ 50(43), $Al_2TiO_5$ 30(33) | $3 \times 10^5$ | −20 |
| 11 | $Al_2O_3$ 10(13), $ZrO_2$ 40(37), $SrTiO_3$ 50(50) | $8 \times 10^4$ | −24 |
| 12 | $Al_2O_3$ 10(14), $ZrO_2$ 60(60), CoO 30(26) | $6 \times 10^2$ | −14 |
| 13 | $Al_2O_3$ 5(1), $ZrO_2$ 65(64), ZnO 30(29) | $4 \times 10^4$ | −25 |
| 14 | $ZrO_2$ 60(65), NiO 40(35) | $2 \times 10$ | −12 |

TABLE 2-continued

| Sample No. | Sintered mixture composition wt. % (vol. %) 1 wt. % of MgO added on the basis of $Al_2O_3$ and 8 wt. % of $Y_2O_3$ added on the basis of $ZrO_2$ | Specific resistance at 20° C. (Ωcm) | Electric noise current (dB) |
|---|---|---|---|
| Brass rotor electrode | | | 0 |

EXAMPLE 3

Antimony oxide ($Sb_2O_3$) was added to zinc oxide (ZnO) powder in a ratio of the former to the latter of 4% by volume, and further zirconium oxide ($ZrO_2$) was added thereto in various mixing ratios. The resulting powdery mixtures were molded under a pressure of 1,000 kg/cm$^2$ and then sintered in the air at a temperature of 1,300° C. for 3 hours. Rotor electrodes were prepared from the resulting sintered mixtures and mounted on ignition distributors for internal combustion engines, as shown in FIG. 1.

Electric noise current generated from the ignition distributors was measured in the similar manner as in Example 1.

Compositions and specific resistances of sintered mixtures, and results of measurement of electric noise current based on the conventional brass rotor electrode as the reference are shown in Table 3. As is evident from the results, the resistance is too high when the sintered mixture contains less than 40% by volume of ZnO, and thus the sintered mixture cannot be used as a rotor electrode.

TABLE 3

| Sample No. | Sintered mixture composition (% by volume) | Specific resistance at 20° C. (Ωcm) | Electric noise current (dB) |
|---|---|---|---|
| 15 | ZnO 38.4, $Sb_2O_3$ 1.6, $ZrO_2$ 60 | $2 \times 10^9$ | — |
| 16 | ZnO 48, $Sb_2O_3$ 2, $ZrO_2$ 50 | $5 \times 10^6$ | −16 |
| 17 | ZnO 52.8, $Sb_2O_3$ 2.2, $ZrO_2$ 45 | $2 \times 10^5$ | −18 |
| 18 | ZnO 67.2, $Sb_2O_3$ 2.8, $ZrO_2$ 30 | $5 \times 10^4$ | −22 |
| 19 | ZnO 76.8, $Sb_2O_3$ 3.2, $ZrO_2$ 20 | $4 \times 10^4$ | −20 |
| 20 | ZnO 86.4, $Sb_2O_3$ 3.6, $ZrO_2$ 10 | $2 \times 10^4$ | −17 |
| 21 | ZnO 91.2, $Sb_2O_3$ 3.8, $ZrO_2$ 5 | $1 \times 10^4$ | −12 |
| 22 | ZnO 95.04, $Sb_2O_3$ 3.96, $ZrO_2$ 1 | $3 \times 10^3$ | −5 |
| Brass rotor electrode | | | 0 |

As is also evident from the results, a high noise-suppressing effect of more than 10 dB can be obtained when the sintered mixture contains 50 to 95% by volume of ZnO.

When copper or stainless steel stationary electrodes were used, similar noise-suppressing effect could be obtained.

EXAMPLE 4

Composition A of cobalt oxide (CoO) powder containing 0.1% by mole of lithium carbonate ($Li_2CO_3$) on the basis of cobalt oxide and composition of B of nickel oxide (NiO) powder containing 7% by mole of lithium carbonate ($Li_2CO_3$) on the basis of nickel oxide were prepared. These mixtures were each mixed with $ZrO_2$ in various mixing ratios, and the resulting mixtures were molded and sintered at a temperature of 1,350° C. for 3 hours. Rotor electrodes were prepared from the sintered mixtures, and noise electric current was measured in the similar manner as in Example 1.

Compositions and specific resistance of sintered mixtures and results of measurement of electric noise current are shown in Table 4. When the sintering mixture contains less than 40% by volume of composition A or B, the resistance is so high that it cannot by used as a rotor electrode. It has been found by X-ray diffraction that lithium carbonate is decomposed during the sintering and diffused into cobalt oxide or nickel oxide, and that the compositions A and B consist essentially of CoO and NiO, respectively. As is evident from the results, a high noise-suppressing effect of more than 10 dB can be obtained, when the sintered mixture contains 40 to 95% by volume of composition A or B.

When copper and stainless steel stationary electrodes were used, similar results could be obtained.

TABLE 4

| Sample No. | Sintered mixture composition (% by volume) | Specific resistance at 20° C. (Ωcm) | Electric noise current (dB) |
|---|---|---|---|
| 23 | Composition(A) 35, $ZrO_2$ 65 | $2 \times 10^7$ | — |
| 24 | Composition(A) 45, $ZrO_2$ 55 | $1 \times 10^5$ | −15 |
| 25 | Composition(A) 70, $ZrO_2$ 30 | $4 \times 10^4$ | −24 |
| 26 | Composition(A) 90, $ZrO_2$ 10 | $1 \times 10^4$ | −18 |
| 27 | Composition(A) 97, $ZrO_2$ 3 | $4 \times 10^2$ | −4 |
| 28 | Composition(B) 35, $ZrO_2$ 65 | $3 \times 10^7$ | — |
| 29 | Composition(B) 45, $ZrO_2$ 55 | $2 \times 10^5$ | −14 |
| 30 | Composition(B) 70, $ZrO_2$ 30 | $6 \times 10^4$ | −17 |
| 31 | Composition(B) 90, $ZrO_2$ 10 | $2 \times 10^4$ | −12 |
| 32 | Composition(B) 97, $ZrO_2$ 3 | $5 \times 10^2$ | −3 |
| Brass rotor electrode | | | 0 |

EXAMPLE 5

Still further sintered mixture compositions were investigated according to Example 3. A sintered mixture of 70 vol. % ZnO-25 vol. % $ZrO_2$-5 vol. % MgO (sample No. 33) had an electric noise current of −15 dB, when prepared into a rotor electrode, and similarly a sintered mixture of 70 vol. % ZnO-10 vol. % NiO-20 vol. % $ZrO_2$ (sample No. 34) had an electric noise current of −18 dB when prepared into a rotor electrode. On the basis of the conventional brass rotor electrode as a reference.

EXAMPLE 6

Sintered mixtures having compositions shown in Table 5 were prepared by molding under a pressure of 1,000 kg/cm$^2$ and sintered in the air at 1,300° C. for 3 hours, and prepared into rotor electrodes. The specific resistance at 20° C. and electric noise current thereof are shown in Table 5.

TABLE 5

| Sample No. | Sintered mixture composition % by weight (% by volume) | Specific resistance at 20° C. (Ωcm) | Electric noise current (dB) |
|---|---|---|---|
| 35 | $ZrO_2$ 31(36), ZnO 60(58), $TiO_2$ (9), MgO 2(3) | $1.5 \times 10^4$ | −23 |
| 36 | $ZrO_2$ 28(28), ZnO 70(70), $Sb_2O_3$ 2(2) | $2 \times 10^5$ | −20 |
| 37 | $ZrO_2$ 48(47), ZnO 47(46), $Al_2O_3$ 5(7) | $8 \times 10^3$ | −17 |
| 38 | $ZrO_2$ 50(50), ZnO 49(49), $Sb_2O_3$ 1(1) | $7 \times 10^5$ | −13 |

What is claimed is:

1. An ignition distributor for an internal combustion engine, which comprises a rotor electrode capable of rotary motion and a plurality of stationary electrodes arranged substantially in a circle around the rotor electrode through an electric discharge clearance therebetween, the rotor electrode being made of a sintered mixture of $ZrO_2$ and an oxide selected from the group consisting of ZnO, NiO and CoO; or a sintered mixture of $ZrO_2$, aluminum oxide, and an oxide selected from the group consisting of ZnO, CoO, $Al_2TiO_5$ and $SrTiO_3$ or a carbide selected from the group consisting of ZrC, TiC and TaC, the sintered mixture having a specific resistance of not more than $10^6$ Ωcm at room temperature.

2. An ignition distributor according to claim 1, wherein the rotor electrode is made of the sintered mixture having a specific resistance of 10 to $10^6$ Ωcm at room temperature.

3. An ignition distributor according to claim 1, wherein the rotor electrode contains zinc oxide and zirconium oxide in a ratio of the former to the latter of 7:3 by volume and contains a specific resistance-controlling agent.

4. An ignition distributor according to claim 3, wherein the specific resistance-controlling agent is antimony oxide, aluminum oxide, titanium oxide or magnesium oxide.

5. An ignition distributor according to claim 1, wherein the sintered mixture consists essentially of 40–95% by volume of an oxide selected from the group consisting of ZnO, NiO and CoO, with the balance being $ZrO_2$.

6. An ignition distributor according to claim 1, wherein the sintered mixture consists essentially of 37–64% by volume of $ZrO_2$, 7–24% by volume of $Al_2O_3$, and 26–50% by volume of an oxide selected from ZnO, CoO, $Al_2TiO_5$ and $SrTiO_3$.

7. An ignition distributor according to claim 1, wherein the sintered mixture consists essentially of 4–44% by volume of a carbide selected from the group consisting of ZrC, TiC and TaC.

8. An ignition distributor according to claim 1, wherein the sintered mixture additionally includes, as an insulating oxide together with $ZrO_2$, at least one material selected from the group consisting of $SiO_2$, $ZnAl_2O_4$, $CoAl_2O_4$, $NiAl_2O_4$, $ZnSiO_4$ and $Co_2SiO_4$.

* * * * *